United States Patent [19]

Miehe et al.

[11] Patent Number: 5,064,221

[45] Date of Patent: Nov. 12, 1991

[54] METHOD FOR DISTINGUISHING PRINTED ORIGINALS FROM COPIES

[75] Inventors: Friedrich-Viktor Miehe; Stephan Günther, both of Berlin, Fed. Rep. of Germany

[73] Assignee: Francotyp-Postalia GmbH, Berlin, Fed. Rep. of Germany

[21] Appl. No.: 487,526

[22] Filed: Mar. 2, 1990

[30] Foreign Application Priority Data

Mar. 2, 1989 [DE] Fed. Rep. of Germany ..... 3906945

[51] Int. Cl.[5] ..... B42D 15/00

[52] U.S. Cl. ..... 283/67; 283/92; 283/902

[58] Field of Search ..... 283/92, 902, 67; 428/916

[56] References Cited

U.S. PATENT DOCUMENTS

| | | | |
|---|---|---|---|
| 3,614,430 | 10/1971 | Berler | 283/92 |
| 3,628,271 | 12/1971 | Carrell | 283/92 |
| 3,886,083 | 5/1975 | Laxer | 283/92 |
| 4,066,280 | 1/1978 | LaCapria | 283/902 |
| 4,429,318 | 1/1984 | Kobata . | |
| 4,451,521 | 5/1984 | Kaule et al. | 283/92 |
| 4,522,429 | 6/1985 | Gardner et al. | 283/902 |
| 4,627,642 | 12/1986 | Peronneau et al. | 283/92 |
| 4,791,449 | 12/1988 | Foley et al. | 283/902 |

FOREIGN PATENT DOCUMENTS

| | | | |
|---|---|---|---|
| 2802717 | 7/1979 | Fed. Rep. of Germany | 283/92 |
| 2139955 | 11/1984 | United Kingdom | 283/92 |

*Primary Examiner*—Frank T. Yost
*Assistant Examiner*—Hwei-Siu Payer
*Attorney, Agent, or Firm*—Herbert L. Lerner; Laurence A. Greenberg

[57] ABSTRACT

In order to distinguish originals from copies, a method adds substances to printing medium that produces markings, which are not visible to the naked eye and are only recognizable by using special scanners.

8 Claims, No Drawings

METHOD FOR DISTINGUISHING PRINTED ORIGINALS FROM COPIES

The invention relates to a method for distinguishing printed originals from copies.

In many applications in printing technology, it is necessary to distinguish an original from copies, such as in the case of printed tax or postage fees and the like. With modern copying methods, such printed material can be reproduced at will and is virtually indistinguishable from the original, especially if it is printed on adhesive strips as in the case with postage meters.

For documents, it is known from German Published, Non-Prosecuted Application DE-OS 34 19 859 to incorporate warning markers in the printing that are rendered optically invisible by being the same color and density as the background and having other printed material or patterns superimposed thereon. Not until they are copied do the warning markings become visible. It is also known from German Patent DE-PS 28 05 146 to use a safety paper for the original, on which the color density of the security markings is below the reproduction threshold of color copiers.

However, such methods are complicated and sometimes cannot be used if direct printing onto various substrates is required, as in the case with letters or various receipt forms.

It is accordingly an object of the invention to provide a method for distinguishing printed originals from copies, which overcomes the hereinafore-mentioned disadvantages of the heretofore-known methods of this general type and with which copies or forgeries can be distinguished from originals for the last-mentioned purpose, that is for printing monetary values directly onto various printed forms.

With the foregoing and other objects in view there is provided, in accordance with the invention, a method for distinguishing printed originals from copies, which comprises adding substances to a printing medium for producing invisible markings in a printed original being recognizable solely by means of special scanners.

In accordance with another mode of the invention, there is provided a method which comprises using an ink ribbon as the printing medium, and covering the ink ribbon with lines, grids or patterns of the substance.

In accordance with a further mode of the invention, there is provided a method which comprises delivering the substances from a supply container through nozzles to a substrate to be imprinted with heat-sensitive or chemical printing in the form of grids or lines.

In accordance with a concomitant mode of the invention, there is provided a method which comprises using fluorescent substances as the substance.

Other features which are considered as characteristic for the invention are set forth in the appended claims.

Although the invention is illustrated and described herein as embodied in a method for distinguishing printed originals from copies, it is nevertheless not intended to be limited to the details shown, since various modifications and structural changes may be made therein without departing from the spirit of the invention and within the scope and range of equivalents of the claims.

The method of operation of the invention, however, together with additional objects and advantages thereof will be best understood from the following description of specific embodiments.

Referring now to the features of the invention in detail, the object of making copies or forgeries distinguishable from originals for printing monetary values directly onto various printed forms is attained by adding substances to the printing medium that produce markings in the original print that are invisible to the naked eye and therefore are invisible for copying purposes.

When an ink ribbon is the printing medium, markings of the invisible substance cover the ink ribbon in the form of lines, grids, or patterns, and are applied along with the stamp on the printed substrate, such as in the case of postage meters or other systems that print stamps having monetary values.

When inks are used, the substances can be sprayed through nozzles from a special supply container, and lines and grids are produced by means of the printer control.

It is known that in ink jet writers or ink droplet recording of a printed original, substances may be admixed with the ink supply. Preferably, fluorescent substances are used as such substances.

Special scanners then allow the difference between the originals and the copies to be recognized.

We claim:

1. Method for making printed originals distinguishable from copies, which comprises:

(a) using an ink ribbon as a printing medium for printing originals;

(b) adding a substance to the ink ribbon in the form of a marking;

(c) printing an original with the marked ink ribbon for producing invisible distinguishable markings in the printed original being recognizable solely by means of special scanners.

2. Method according to claim 1, which comprises using fluorescent substances as the substance.

3. Method according to claim 1, which comprises adding markings in the form of lines of the substance to the ink ribbon.

4. Method according to claim 3, which comprises using fluorescent substances as the substance.

5. Method according to claim 1, which comprises adding markings in the form of grids of the substance to the ink ribbon.

6. Method according to claim 5, which comprises using fluorescent substances as the substance.

7. Method according to claim 1, which comprises adding markings in the form of patterns of the substance to the ink ribbon.

8. Method according to claim 7, which comprises using fluorescent substances as the substance.

* * * * *